US007473161B2

(12) United States Patent
Nakajima

(10) Patent No.: US 7,473,161 B2
(45) Date of Patent: Jan. 6, 2009

(54) LAPPING MACHINE AND HEAD DEVICE MANUFACTURING METHOD

(75) Inventor: Kiyotaka Nakajima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/595,908

(22) Filed: Nov. 13, 2006

(65) Prior Publication Data

US 2008/0026677 A1 Jan. 31, 2008

(30) Foreign Application Priority Data

Jul. 28, 2006 (JP) ..... 2006-205654

(51) Int. Cl.
*B24B 49/00* (2006.01)

(52) U.S. Cl. ..... 451/8; 451/6; 451/41; 451/57; 29/603.1

(58) Field of Classification Search ..... 451/5, 451/6, 8, 41, 57, 908; 29/603.1, 603.09, 29/603.13

See application file for complete search history.

(56) References Cited

U.S. PATENT DOCUMENTS 6,315,636 B1 11/2001 Yanagida et al.
6,375,539 B1 * 4/2002 Sudo et al. ..... 451/5
6,699,102 B2 * 3/2004 Reiley et al. ..... 451/8
6,722,947 B2 * 4/2004 Nishioka et al. ..... 451/10
6,913,509 B2 * 7/2005 Sone et al. ..... 451/5
6,935,923 B2 * 8/2005 Burbank et al. ..... 451/5
2005/0095956 A1 5/2005 Fujii et al.

FOREIGN PATENT DOCUMENTS

JP 2005-7571 1/2005
JP 2005-131727 5/2005

* cited by examiner

*Primary Examiner*—Joseph J. Hail, III
*Assistant Examiner*—Anthony Ojini
(74) *Attorney, Agent, or Firm*—Kratz, Quintos & Hanson, LLP.

(57) ABSTRACT

A lapping machine that polishes a head block in which plural head devices are connected in a row includes a jig that has a bottom surface that opposes to a grinding plane, and fixes the head block onto the bottom surface, a pressure mechanism that applies a pressure to the head block against the grinding plane, a detector that is connected to the head block and detects a grinding amount of the head block, and a dummy block fixed onto the bottom surface adjacent to the head block.

6 Claims, 14 Drawing Sheets

110
10

110
120A
10

110
120A
10

PRIOR ART

PRIOR ART

PRIOR ART

LAPPING MACHINE AND HEAD DEVICE MANUFACTURING METHOD

This application claims the right of a foreign priority based on Japanese Patent Application No. 2006-205654, filed on Jul. 28, 2006, which is hereby incorporated by reference herein in its entirety as if fully set forth herein.

BACKGROUND OF THE INVENTION

The present invention relates generally to a lapping or grinder machine and a head device manufacturing method, and more particularly to a lapping machine that equalizes the height of a head block (also referred to as a "row bar") in which plural head devices are connected in row, and a method that grinds or polishes the head block and manufactures the head device. The present invention is suitable, for example, for a lapping machine for a head device in a hard disc drive ("HDD").

Along with the recent spread of the Internet etc., inexpensive hard disc drives that can record a large amount of information including images have been increasingly demanded. When the surface recording density is increased to meet the demand for the large capacity, a minimum unit of the magnetic recording information or a 1-bit area reduces on the recording medium, weakening a signal magnetic field obtained from the recording medium. A small and highly sensitive read head is necessary to read the weak signal magnetic field. A high-quality polishing process that makes constant the height of the head block is necessary for the highly sensitive read head. In addition, an expensive magnetic disc drive needs an improved yield of the lapping process and an improved economic efficiency of the lapping machine.

The head block is a workpiece made by cutting many magnetic heads formed on a wafer in a strip or bar shape. Since the head block is too thin to be directly attached to the lapping machine, it is first attached to a jig before attached to the lapping machine. The working amount of the head block is controlled through an electrical lapping guide ("ELG") device or a resistance lapping guide ("RLG") sensor that is attached to the head block and detects a working amount as resistance.

This assignee has proposed a lapping machine in Japanese Patent Application, Publication No. ("JP") 2005-007571, as shown in FIG. 10. A head block 10 adhered to a bottom surface of a jig 20 contacts a grinding plane 2*a* of a lapping board 2. The jig 20 and the head block 10 extend perpendicularly to the paper plane shown in FIG. 10. The jig 20 has a perforation hole 21, and is attached to the back of a lapping machine body 30. A link pressure mechanism 40 is provided on a side surface 20*a* of the jig 20. The link pressure mechanism 40 has a power point P1, a fulcrum P2 as a rotating center, and an action point P3 that gives a perpendicular power to the jig 20 in the hole 21. For example, when the power point P1 displaces to the right in FIG. 10, the action point P3 displaces down, and the force that compresses the head block 10 against the grinding plane 2*a* increases. On the other hand, when the power point P1 displaces to the left, the action point P3 displaces up, and the force that compresses the head block 10 against the grinding plane 2*a* decreases.

The pressure by the pressure mechanism 40 concentrating only on the head block 10 would damage each head device and lower the yield. Therefore, JP 2005-1311727 proposes a dummy block that shares the load applied to the head block 10 as shown in FIGS. 11 and 12. In FIG. 11, a transfer tool 22 is attached to the back of a lapping machine body 30A, the head block 10 is adhered to a bottom surface of a jig 20A, and a dummy block 12 is adhered to a bottom surface of a jig 24. A keeper 26 connects jigs 20A and 24 to each other. The transfer tool 22 supports the jig 20A, and has a signal line that transmits an output from the RLG sensor to a controller. In FIG. 12, another jig 28 is provided on a bottom surface of the keeper 26, and another dummy block 14 is adhered onto it. The dummy block 14 is provided between the head block 10 and the dummy block 12; there are two dummy blocks 12 and 14.

According to the structure shown in FIG. 10, the lapping machine 30 directly pressures the jig 20 that supports the head block 10 using the pressure mechanism 40, while according to the structure shown in FIG. 11, the lapping machine 30A pressures the jig 20A that supports the head block 10 via the transfer tool 22. When the jig 20A inclines on the attachment surface 22*a* due to the error at which the jig 20A is attached to the transfer tool 22, the pressure applied by the transfer tool 22 is not uniform among the magnetic head devices in the head block 10, lowering the yield.

In addition, a connection between the transfer tool 22 and the RLG sensor is arduous, and this inventor has studied a configuration that fixes a printed board onto the side surface 20*b* of the jig 20 in FIG. 10 and an output of an ELG device is received via wires. In that case, the jig 20 shown in FIG. 10 serves as both the jig 20A and the transfer tool 22 in FIG. 11. In addition, this inventor has studied the configuration shown in FIGS. 11 and 12, which connects the dummy block 12 or the dummy blocks 12 and 14 to the side surface 20*b* via the keeper 26 and the jig 24. However, this inventor has discovered that the configuration that arranges, as shown in FIG. 11 or 12, the dummy blocks 12 and 14 on the jig 20 shown in FIG. 10 causes problems of a difficult manufacture of the lapping machine, a lowered yield of the polished magnetic head device, and a large size of the lapping machine.

In other words, it is difficult to connect the keeper 26 to the side surface 20*b* since the side surface 20*b* is mounted with the printed board and wire connections. In addition, the structures shown in FIGS. 11 and 12 requires that the bottom surface of the head block 10 and the bottom surfaces of the dummy blocks 12 and 14 be coplanar, but the coplanarity is difficult due to the processing and attachment accuracies of the jigs 20A, 24, and 28. Without the coplanarity, the load sharing functions of the dummy blocks 12 and 14 deteriorate. Moreover, the long keeper 26 increases a distance between the head block 10 and the dummy block 12, introducing diamonds and lap dusts included in the slurry between them, and causing damages of the tunneling magnetoresistive ("TuMR") device and short circuit in the head block 10. On the other hand, use of fine diamonds may reduce damages of the head block 10, but fine diamond is expensive. In addition, the keeper 26 and the jig 24 preclude a miniaturization of the apparatus.

BRIEF SUMMARY OF THE INVENTION

Accordingly, it is an exemplified object of the present invention to provide an easily manufactured lapping machine with an excellent yield, and a head device manufacturing method.

A lapping machine according to one aspect of the present invention that polishes a head block in which plural head devices are connected in a row includes a jig that has a bottom surface that opposes to a grinding plane, and fixes the head block onto the bottom surface, a pressure mechanism that applies a pressure to the head block against the grinding plane, a detector that is connected to the head block and detects a grinding amount of the head block, and a dummy block fixed onto the bottom surface adjacent to the head block. This jig (transfer tool) has the dummy block adjacent to the head block on the bottom surface of the jig, because it is difficult to provide the dummy block on the side surface as in JP 2005-131727 when the pressure mechanism and the printed board are arranged at both sides of the jig. The dummy block blocks diamonds and lap dusts that exist on the lapping board or grinding plane and prevents damages of the TuMR device in the head block by providing the dummy block on the upstream side and reducing a distance between the dummy block and the head block. Therefore, the yield improves even without expensive fine diamonds. The inventive lapping machine fixes both blocks on the bottom surface of the same component, i.e., the jig. When these blocks are attached to separate members as in JP 2005-131727, it is difficult to maintain the coplanarity of the bottom surfaces of both blocks on the grinding plane side due to processing errors of the separate members and the attachment errors of both blocks. The inventive lapping machine thus facilitates maintenance of the coplanarity of the bottom surfaces of both blocks on the grinding plane side. The inventive lapping machine does not require the keeper 26 or the jig 24 unlike JP 2005-131727, and can maintain the miniaturization of the lapping machine.

Preferably, a surface of the head block on a side of the grinding plane and a surface of the dummy block on the side of the grinding plane are parallel to the grinding plane and coplanar. Preferably, a width of the dummy block is constant, and a total of the width is more than twice as long as the head block. For plural dummy blocks, the "total of the width" means a total of the widths of the dummy blocks. For one dummy block, the "total of the width" means one width. This configuration can provide high-quality polishing of the head block.

The jig may have first and second side surfaces perpendicular to the bottom surface, and a perforation hole that perforates through the first and second side surfaces, and the pressure mechanism may use a linkage that partially protrudes in the perforation hole in the jig. When the pressure mechanism uses the linkage as in JP 2005-007571, the jig is thicker than the head block. It is therefore unnecessary to provide a mounting space of the dummy block on the bottom surface of the jig or to thicken the jig, maximizing the existing space.

Preferably, the lapping machine further includes a follow-up mechanism that makes the surface of the dummy block on the side of the grinding plane follow the grinding plane. Preferably, the material and hardness of the dummy block is the same as those of the head block, thereby the abrasions of both blocks during grinding are equal and the coplanarity parallel to the grinding plane becomes easy to maintain. However, when the head block is made of plural types of materials, the dummy block is made of the same material as the hardest material in the head block. For example, when the head block has a layered structure including a first layer made of $Al_2O_3$—TiC and a second layer made of $Al_2O_3$, the dummy block is preferably made of $Al_2O_3$—TiC. When the dummy block is softer than any one of layers in the head block, the dummy block is more quickly polished and the coplanarity parallel to the grinding plane cannot be maintained. As a result, the load sharing function becomes insufficient.

A head device manufacturing method according to another aspect of the present invention by polishing a head block in which plural head devices are connected in row includes the steps of fixing a head block onto a bottom surface of a jig that has the bottom surface opposing to a grinding plane, and fixing a dummy block onto the bottom surface adjacent to the head block. This manufacturing method can manufacture the above head device more easily. The present invention is particularly suitable when it is difficult to provide the dummy block on any one of the side surfaces. The dummy block is preferably arranged on an upstream side of grinding. The dummy block blocks diamonds and lap dusts that exist on the lapping board or grinding plane and prevents damages of the TuMR device in the head block by providing the dummy block on the upstream side and reducing a distance between the dummy block and the head block. Therefore, the yield improves even without expensive fine diamonds.

A magnetoresistive device manufactured from the head block ground by the above lapping machine, a read head having the magnetoresistive device, and a storage or a recording apparatus having the read head constitute one aspect of the present invention.

Other objects and further features of the present invention will become readily apparent from the following description of the preferred embodiments with reference to accompanying drawings.

DETAILED DESCRIPTION OF THE PREFERRED EMBODIMENTS

Figure 1:
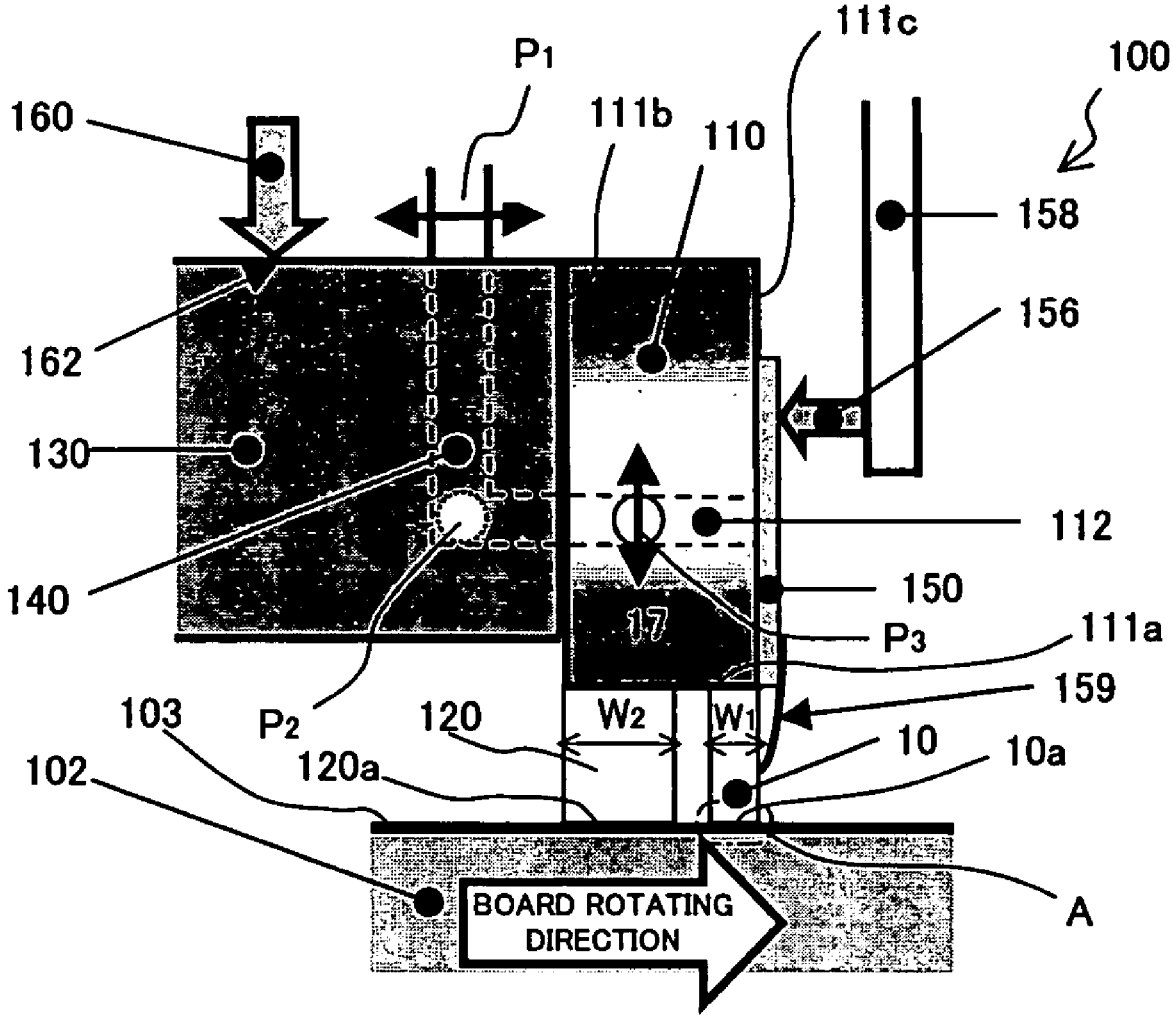
FIG. 1 is a partially enlarged section of principal part of a lapping machine according to one embodiment of the present invention.

Referring now to the accompanying drawings, a description will be given of a lapping machine 100 according to one embodiment of the present invention. Here, FIG. 1 is a schematic partial section of principal part of the lapping machine 100 according to this embodiment. The lapping machine 100 includes a lapping board 102, a transfer tool (jig) 110, a dummy block 120, a machine head 130, a link pressure mechanism 140, a printed board 150, and a follow-up mechanism 160.

The lapping board 102 rotates in an arrow direction, and has a grinding plane 103. Slurry that contains diamonds is supplied to the grinding plane 103 from the left side in FIG. 1. This embodiment does not require expensive fine diamonds, as described later.

Figure 2:
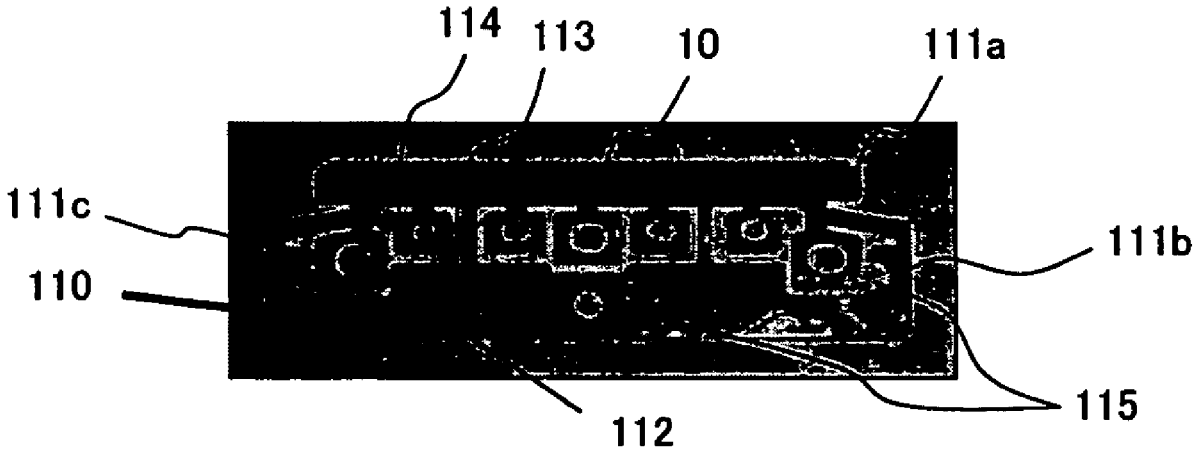
FIG. 2 is a photograph of a front of a transfer tool shown in FIG. 1.

The transfer tool 110 has a plate shape when laterally viewed as shown in FIG. 1, and has a convex shape when viewed from the front as shown in FIG. 2. Here, FIG. 2 is a photograph of the front of the transfer tool 110.

The transfer tool 110 has, as shown in FIGS. 1 and 2, a bottom surface 111*a* that opposes to the grinding plane 103, and a pair of side surfaces 111*b* and 111*c* perpendicular to the bottom surface 111*a*. The transfer tool 110 has seven connection parts 114 defined by slits 113, and each connection part 114 has a perforation hole 112 that perforates through the side surfaces 111*b* and 111*c* parallel to the grinding plane 103 shown in FIG. 1. Each slit 113 can be made, for example, by a wire discharge machining. The transfer tool 110 further has three attachment holes 115 through which the transfer tool 110 is attached to the machine head 130.

The head block 10 is fixed onto the bottom surface 111*a*. The head block 10 is a workpiece in which plural head devices are connected in row, and formed by cutting many magnetic heads formed on the wafer in a strip or bar shape. The head block 10 has a constant width. The head block 10 is adhered to the downstream end of the bottom surface 111*a* by hot melt wax. The downstream end of the bottom surface 111*a* facilitates connections with the printed board 150 through wires 159.

Figure 8:
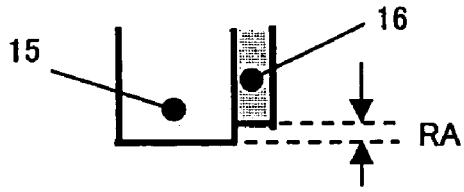
FIG. 8 is a partially enlarged section of A part of a head block shown in FIG. 1.

The head block 10 includes, as shown in FIG. 8, a layer 15 made of $Al_2O_3$—TiC (altic) and a layer 16 made of $Al_2O_3$ (alumina), and arranges the altic layer 15 on the upstream side. The altic layer 15 is harder than the alumina layer 16. When head block 10 is ground in a direction from the alumina layer 16 to the altic layer 15, a recess amount RA increases and the head characteristic (i.e., write and reach capabilities) lowers. Here, FIG. 8 is a partially enlarged section of A part shown in FIG. 1.

Figure 3:
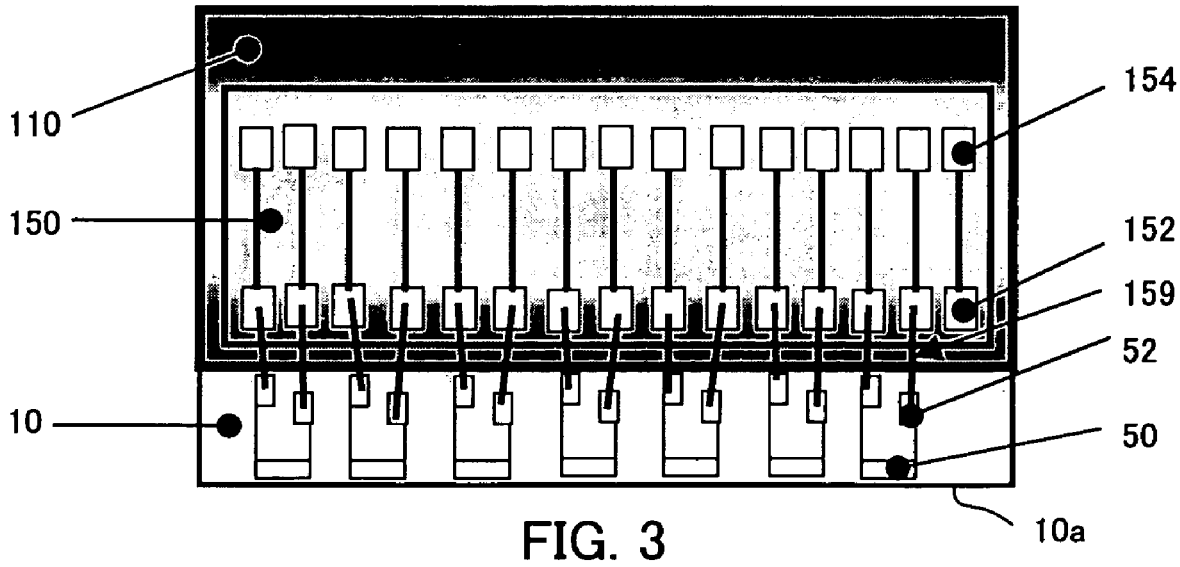
FIG. 3 is a schematic side view of the transfer tool shown in FIG. 1.

The head block 10 has a target surface (bottom surface) 10*a* to be ground or polished, and a detector is attached to the head block 10. The detector has, as shown in FIG. 3, an ELG device 50 that detects a grinding amount as resistance, and an output terminal 52. The ELG device 50 is similar to that disclosed in JP 2005-007571. The output terminal 52 is connected electrically to the ELG device 50 and the wire 159, and transmits the output of the ELG device 50 to the wire 159.

The transfer tool 110 is fixed onto the machine head 130 via the attachment holes 115 in the side surface 111*b*. The machine head 130 has a structure similar to that disclosed in JP 2005-007571.

The dummy block 120 is adhered to the bottom surface 111*a* of the transfer tool 110 by hot melt wax, adjacent to the head block 10. The head block 10 is also a bar having a constant width. The target surface 120*a* of the dummy block 120 on the grinding plane 103 side and the target 10*a* of the head block 10 on the grinding plane 103 side are coplanar and parallel to the grinding plane 103. The dummy block 120 is located on the upstream side of the head block 10. The dummy block 120 serves to take partial charge to the pressure (load) applied by the pressure mechanism 140 to the head block 10.

The transfer tool 110 is fixed onto the machine head 130 on its side surface 111*b*, and the pressure mechanism 140 is arranged next to its side surface 111*b*. The printed board 150 and the wires 159 are fixed on the side surface 111*c*. It is therefore difficult to provide a dummy block onto the transfer tool 110 via the jig 24 and the keeper 26 on any side unlike JP 2005-131727. Accordingly, the dummy block 120 is provided on the bottom surface 111*a* of the transfer tool 110 adjacent to the head block 10.

An arrangement of the dummy block 120 close to the head block 10 can reduce a distance between the dummy block 120 and the head block 10. The dummy block 120 thereby blocks diamonds included in the slurry, preventing diamonds from damaging the head block 10. The dummy block 120 improves the yield even without expensive fine diamonds. A distance between the dummy block 120 and the head block 10 may be zero.

Figure 4:
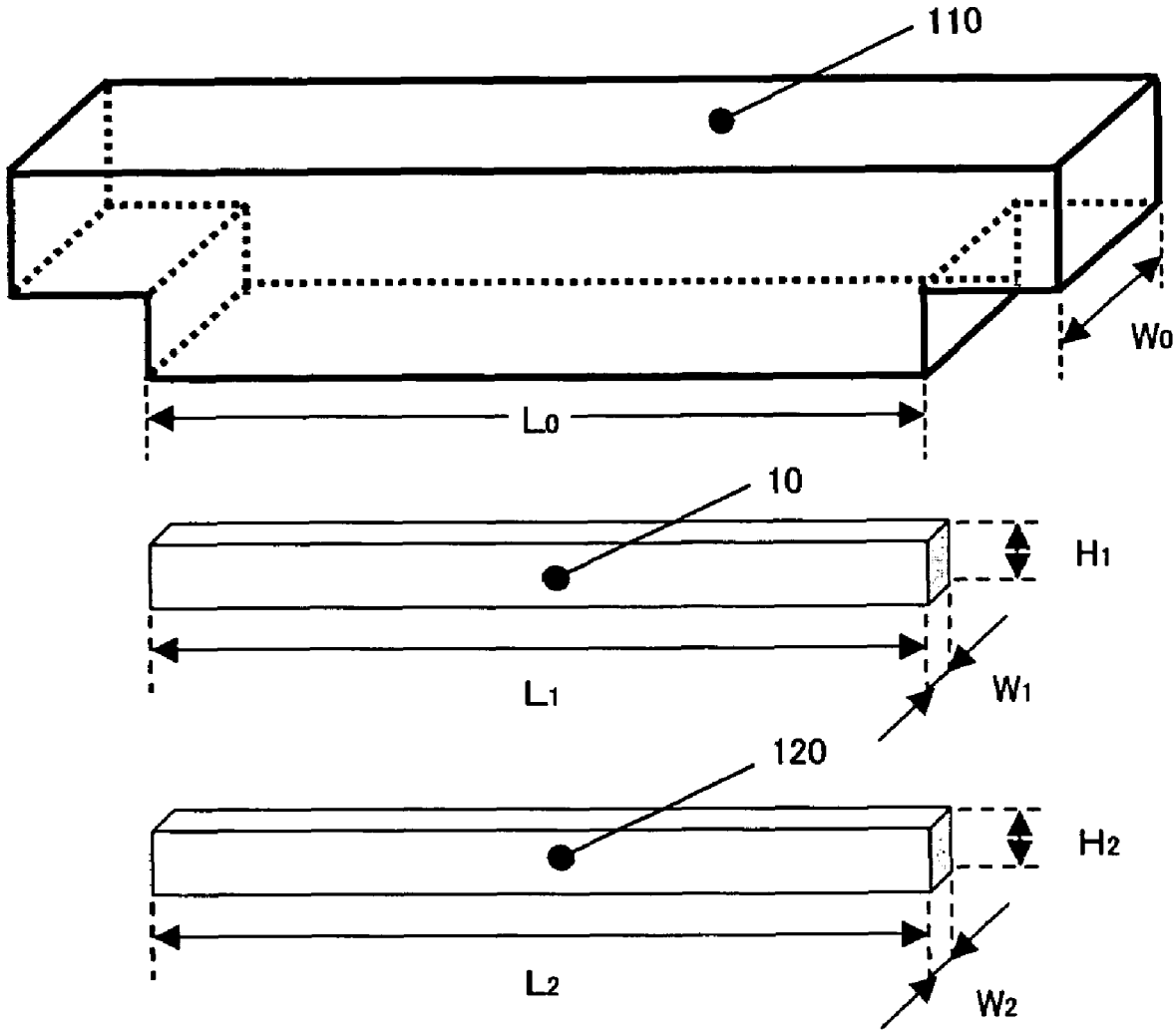
FIG. 4 is a schematic perspective view of the transfer tool, a head block, a dummy block shown in FIG. 1.

FIG. 4 is a schematic perspective view of the transfer tool 110, the head block 10, and the dummy block 120. The convex of the transfer tool 110 has a length Lo, and a width Wo, and the head block 10 has a length $L_1$, a width $W_1$ and a height $H_1$. The dummy block 120 has a length $L_2$, a width $W_2$, and a height $H_2$. FIG. 1 sets the width $W_2$ of the dummy block 120 greater than the width $W_1$ of the head block. $W_2 \geqq W_1$ is preferable to the load sharing effect.

$$L_2 \leqq L_1 \text{ or } L_2 \leqq L_0 \quad \text{[EQUATION 1]}$$

$$W_2 \leqq W_0 - W_1 \quad \text{[EQUATION 2]}$$

Equations 1 and 2 are required for stable holding of the dummy block 120, but are not necessarily required as long as the stable holding is secured.

$$H_2 = H_1 \quad \text{[EQUATION 3]}$$

A condition of Equation 3 is a condition when the bottom surface 111*a* of the transfer tool 110 is flat. As long as the bottom surfaces 120*a* and 10*a* are coplanar, Equation 3 is not necessarily required. For example, the bottom surface 111*a* of the transfer tool 110 shown in FIG. 1 has a convex or concave, and the dummy block 120 is arranged there.

Preferably, the material and hardness of the dummy block 120 are the same as those of the head block 10. This configuration can equalize abrasions of both blocks during grinding, and facilitates maintenance of the coplanarity parallel to the grinding plane 103. However, when the head block 10 is made of plural types of materials, it is preferable that the dummy block 120 is made of the hardest material in the materials of the head block 10. As described above, the head block 10 has a layered structure that includes the layer 15 made of $Al_2O_3$—TiC and the layer 16 made of $Al_2O_3$. Thus, the dummy block 120 is preferably made only of $Al_2O_3$—TiC. When the hardness of the dummy block 120 is lower than that of any one of layers of the head block 10, the dummy block 120 is more quickly polished than the head block 10, and the coplanarity parallel to the grinding plane 103 is unavailable. Then, the load sharing function becomes insufficient.

The dummy block 120 and the head block 10 shown in FIG. 4 are attached to the transfer tool 110 in parallel. In FIG. 1, the width $W_2$ of the dummy block 120 is more than twice as large as the width W1 of the head block 10, and the number of dummy blocks 120 is not limited. Therefore, the dummy block 120 may be parted into two or more.

Figure 5:
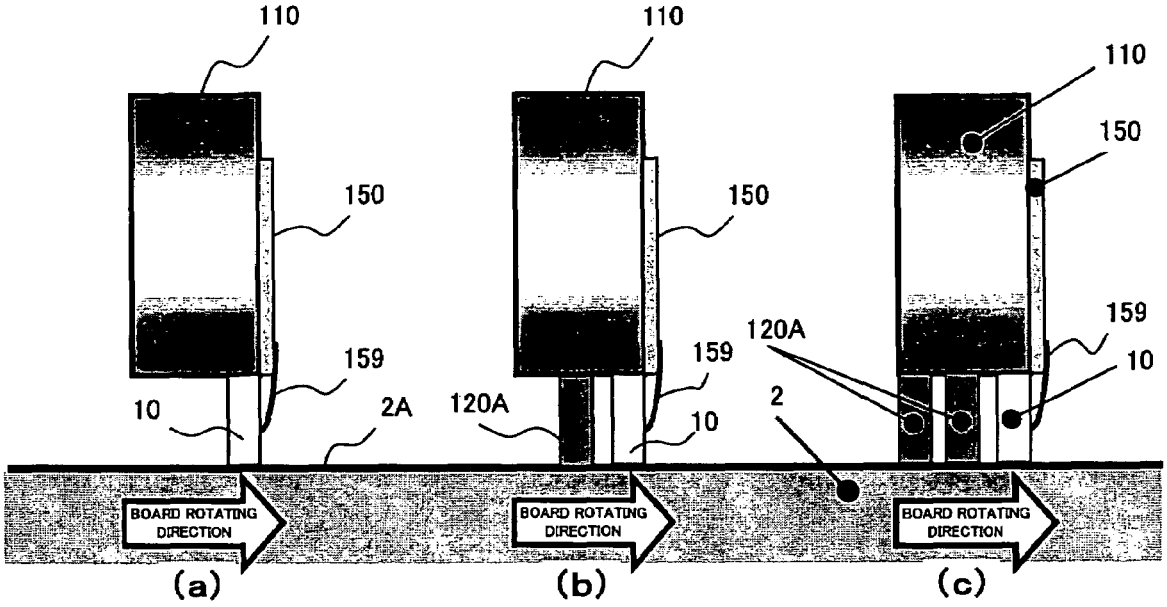
FIG. 5A is a schematic sectional view of the transfer tool that has no dummy block shown in FIG. 1.
FIG. 5B is a schematic sectional view of a transfer tool having one dummy block with a width different from that of the dummy block shown in FIG. 1.
FIG. 5C is a schematic sectional view of a transfer tool that has two dummy blocks with a width different from that of the dummy block shown in FIG. 1.

FIG. 5A is a schematic sectional view of the transfer tool having no dummy block 120. FIG. 5B is a schematic sectional view of the transfer tool 110A having the dummy block 120A of $W_2=W_1$. FIG. 5C is a schematic sectional view of the transfer tool 110B having two dummy blocks 120A of $W_2=W_1$.

Figures 6A, 6B, 6C:
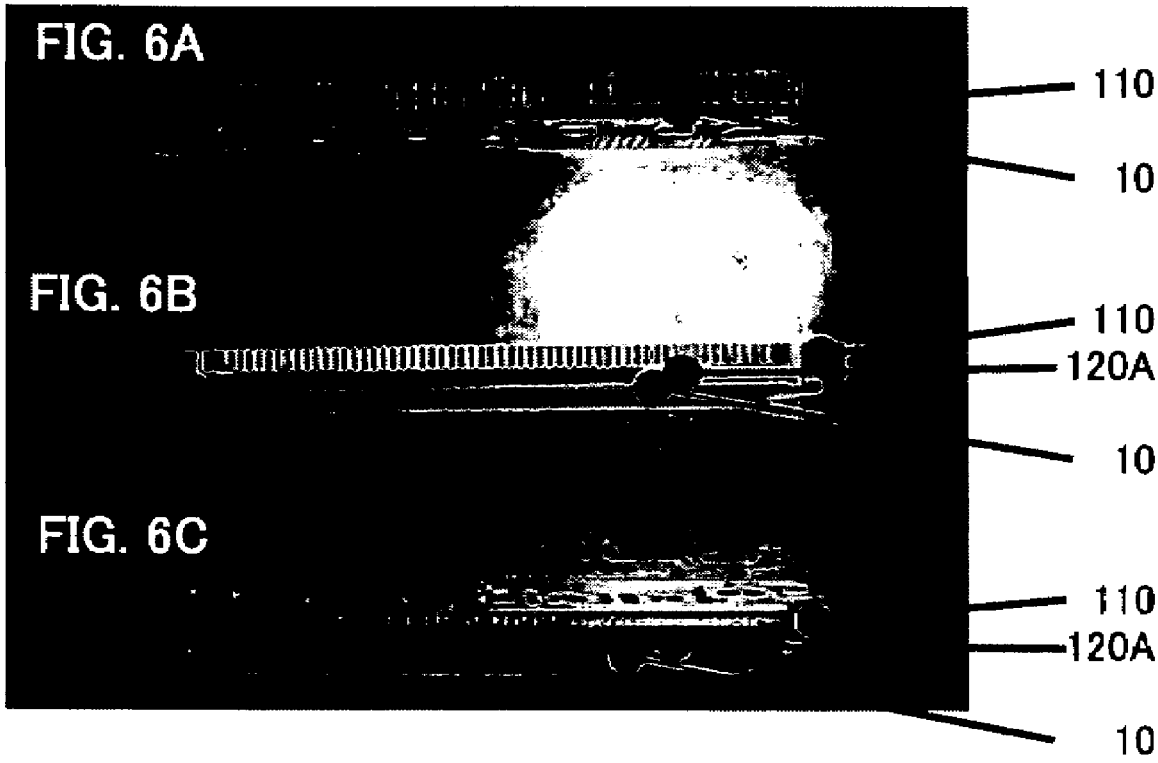
FIG. 6A is a photograph of a bottom surface of the transfer tool corresponding to FIG. 5A.
FIG. 6B is a photograph of a bottom surface of the transfer tool corresponding to FIG. 5B.
FIG. 6C is a photograph of a bottom surface of the transfer tool corresponding to FIG. 5C.

FIG. 6A is a photograph of the bottom surface of the transfer tool corresponding to FIG. 5A. FIG. 6B is a photograph of the bottom surface of the transfer tool 110A corresponding to FIG. 5B. FIG. 6C is a photograph of the bottom surface of the transfer tool 110B corresponding to FIG. 5C.

Figure 7A:
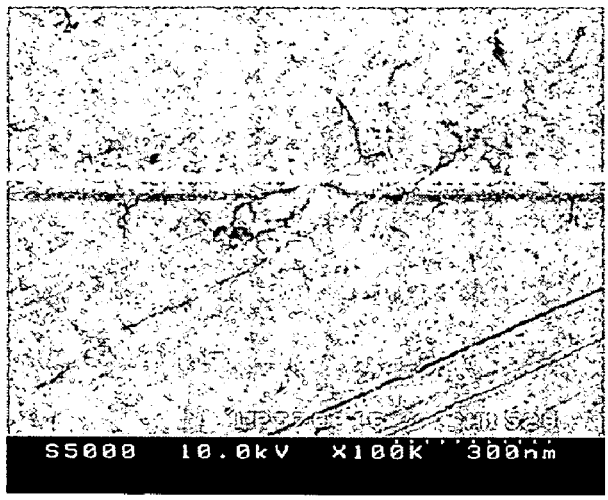
FIG. 7A is a SEM photograph of a magnetic head when the transfer tool corresponding to FIG. 5A is used.
Figure 7B:
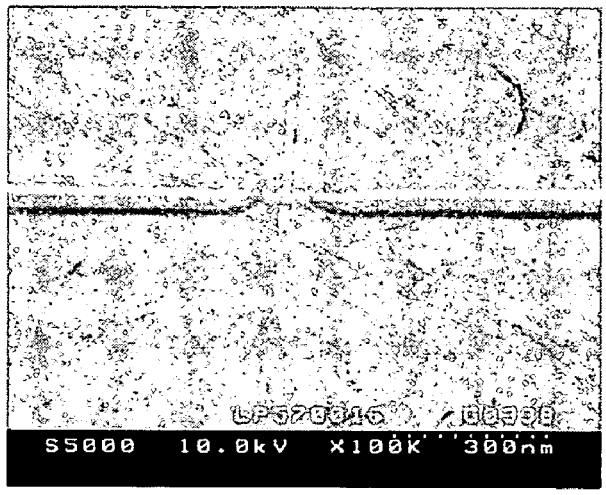
FIG. 7B is a SEM photograph of a magnetic head when the transfer tool corresponding to FIG. 5B is used.
Figure 7C:
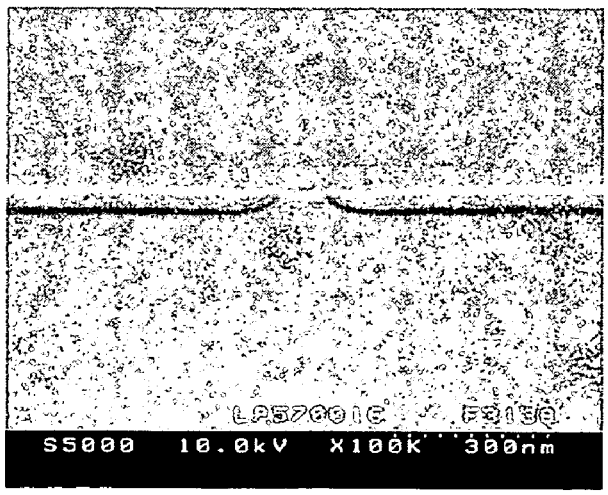
FIG. 7C is a SEM photograph of a magnetic head when the transfer tool corresponding to FIG. 5C is used.

FIG. 7A is a SEM photograph of a magnetic head when the transfer tool corresponding to FIG. 5A is used to polish the magnetic head. FIG. 7B is a SEM photograph of a magnetic head when the transfer tool 110A corresponding to FIG. 5B is used to polish the magnetic head. FIG. 7C is a SEM photograph of a magnetic head when the transfer tool 11C corresponding to FIG. 5C is used to polish the magnetic head. Understandably, the polishing quality of FIG. 7B is higher than that of FIG. 7C. Therefore, Equation 2 preferably satisfies Equation 4.

$$2W_1 \leqq W_2 \leqq W_0 - W_1 \quad \text{[EQUATION 4]}$$

When Equation 4 is met, the high-quality polishing of the head block is available as shown in FIG. 7C. When the number of dummy blocks is one, that dummy block preferably satisfies Equation 4. When plural dummy blocks are used, a total of the widths of the plural dummy blocks preferably satisfies Equation 4. When plural dummy blocks are used, each dummy block may have a different width although each dummy block has the same size in FIG. 5C.

The lapping machine 100 fixes both blocks 10 and 120 onto the bottom surface 111*a* of the transfer tool 110 as a common member. When the head block 10 and the dummy block 120 are attached to the separate jigs 20A and 24 as in JP 2005-131727, it is difficult to maintain the coplanar bottom surfaces of both blocks 10 and 12 on the grinding plane 2*a* side due to the processing errors of the jigs 20A and 24 and the keeper 26 and the attachment errors of both blocks 10 and 12. Without the coplanarity, the load sharing functions of the dummy blocks 12 and 14 are lost. On the other hand, the lapping machine 100 fixes both blocks 10 and 120 onto the same member, thus facilitating the coplanarity of the bottom surfaces 10*a* and 120*a*. In addition, the lapping machine 100 does not use the keeper 26 or jig 24 unlike JP 2005-131727, promoting a miniaturization of the lapping machine 100.

The pressure mechanism 140 applies the pressure to the head block 10 and the dummy block 120 against the grinding plane 103, and is arranged adjacent to the side surface 111*b*. The pressure mechanism 140 uses a linkage similar to that described in JP 2005-007571. The present invention does not limit a type of the pressure mechanism to the linkage. However, when the pressure mechanism uses the linkage as in JP 2005-007571, the action point 146 of the linkage should be placed in the hole 112, and the transfer tool 110 is thicker than the head block 10. Therefore, it is unnecessary to provide a mounting space of the dummy block 120 on the bottom surface 111*a* of the transfer tool 110 or to thicken the transfer tool 110. This embodiment maximizes the existing space, and promotes a miniaturization of the lapping machine 100.

The pressure mechanism 140 includes an L-shaped pin, and has a power point P1, a fulcrum P2 as a rotating center, an action point P3 that projects into the perforation hole 112 and gives a perpendicular power to the transfer tool 110. For example, when the power point P1 displaces to the right in FIG. 1, the action point P3 displaces down, and the force that compresses the head block 10 against the grinding plane 103 increases. On the other hand, when the power point P1 displaces to the left, the action point P3 displaces up, and the force that compresses the head block 10 against the grinding plane 103 decreases.

The printed board 150 is fixed onto the side surface 111*c* of the transfer tool 110. As shown in FIGS. 1 and 3, the printed board 150 has an input terminal 152 and an output terminal 154. The input terminal 152 is connected to the wire 159. The output terminal 154 is connectible to the pin 156. The printed board 150 receives a detection result of the ELG device 50 via the output terminal 52, the wire 159, and the input terminal 152. The received detection result of the ELG device 50 undergoes necessary operations and is output from the output terminal 154. The pin 156 connectible to the output terminal 154 is connected to a probe card 158, which is in turn connected to a controller (not shown) of the lapping machine 100. The controller acquires the detection result of the ELG device 50, and controls the pressure by the pressure mechanism 140. The controller may be provided in the printed board 150.

The follow-up mechanism 160 is provided on the top surface of the machine head 130, and includes a pivot that makes the machine head 130 follow the grinding plane 103. The follow-up mechanism 160 is single-point-supported at a contact 162 on the apparatus body 130, and elastically moves laterally and perpendicularly around the contact 162.

Figure 9:
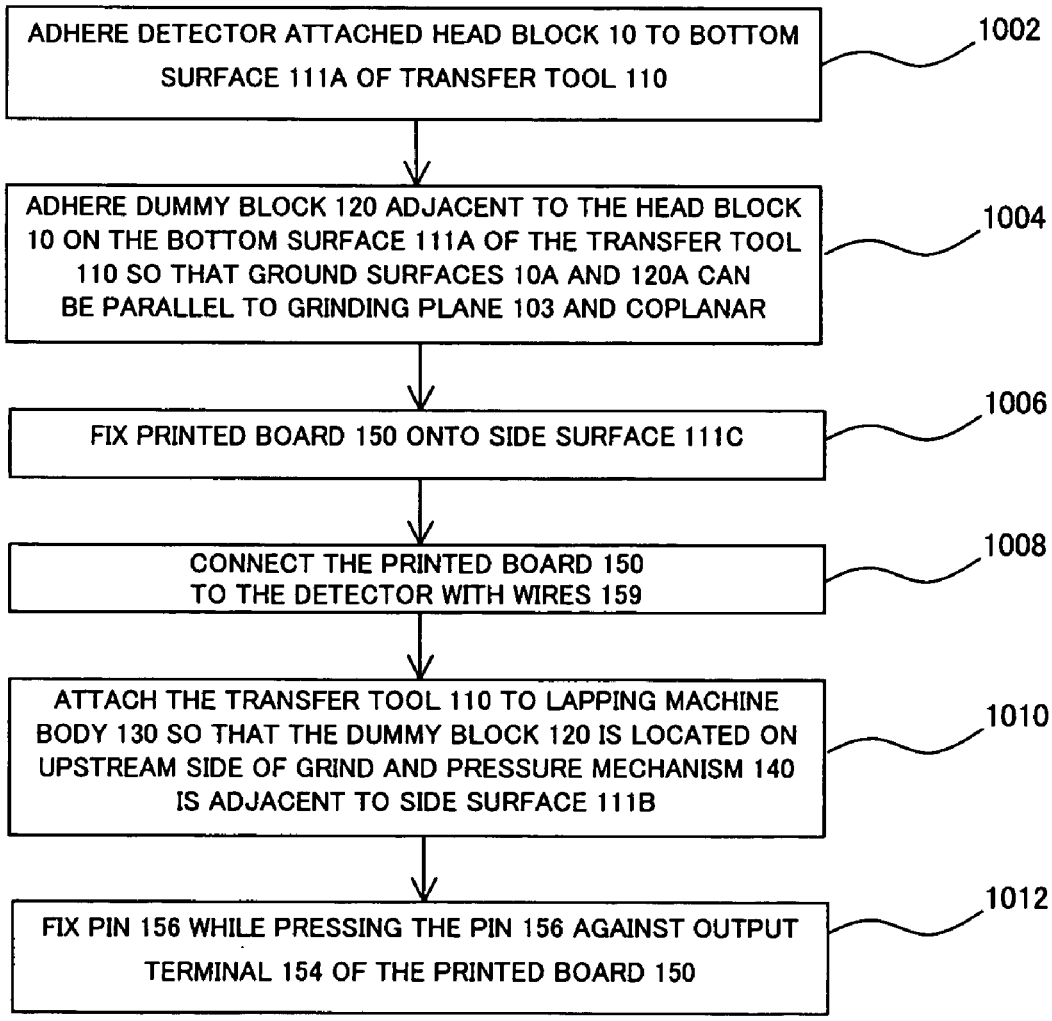
FIG. 9 is a flowchart for explaining a manufacture of principal part of the lapping machine shown in FIG. 1.
Figure 10:
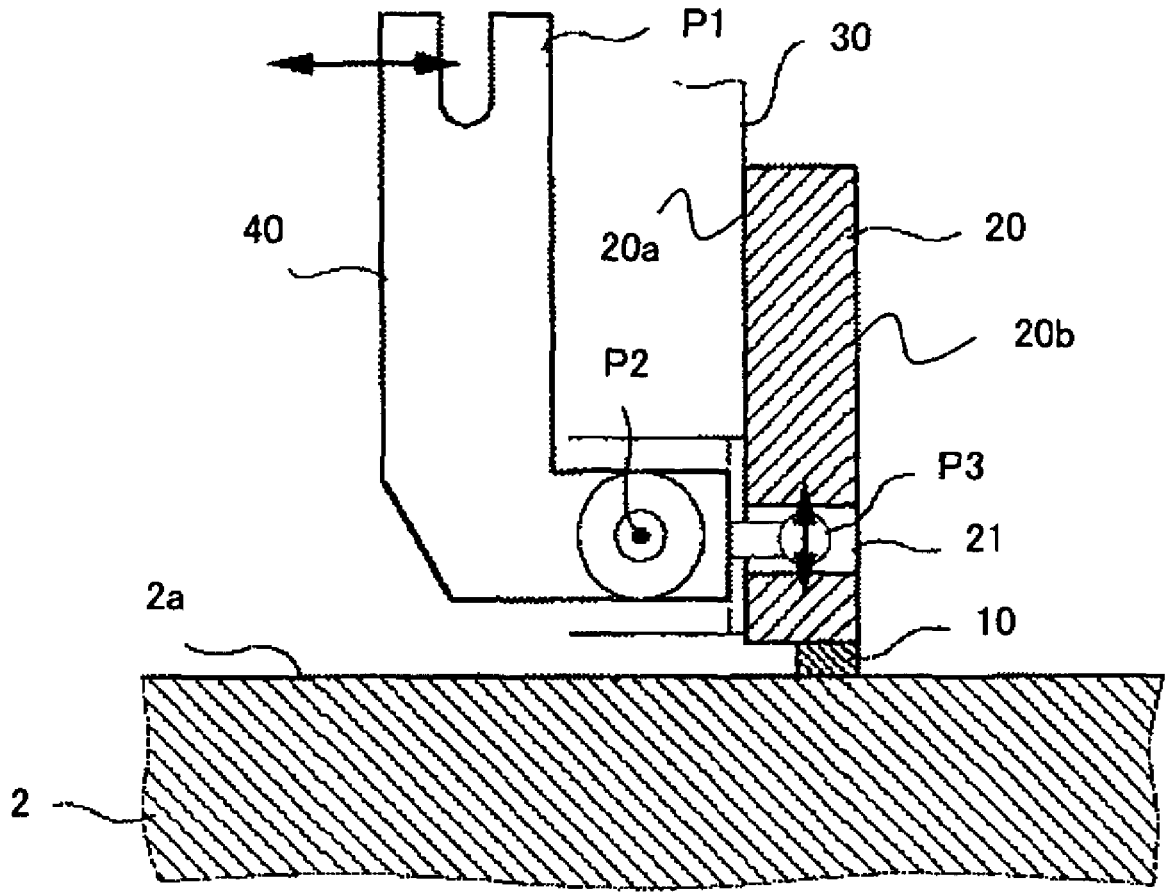
FIG. 10 is a partially enlarged section of principal part of a conventional lapping machine.
Figure 11:
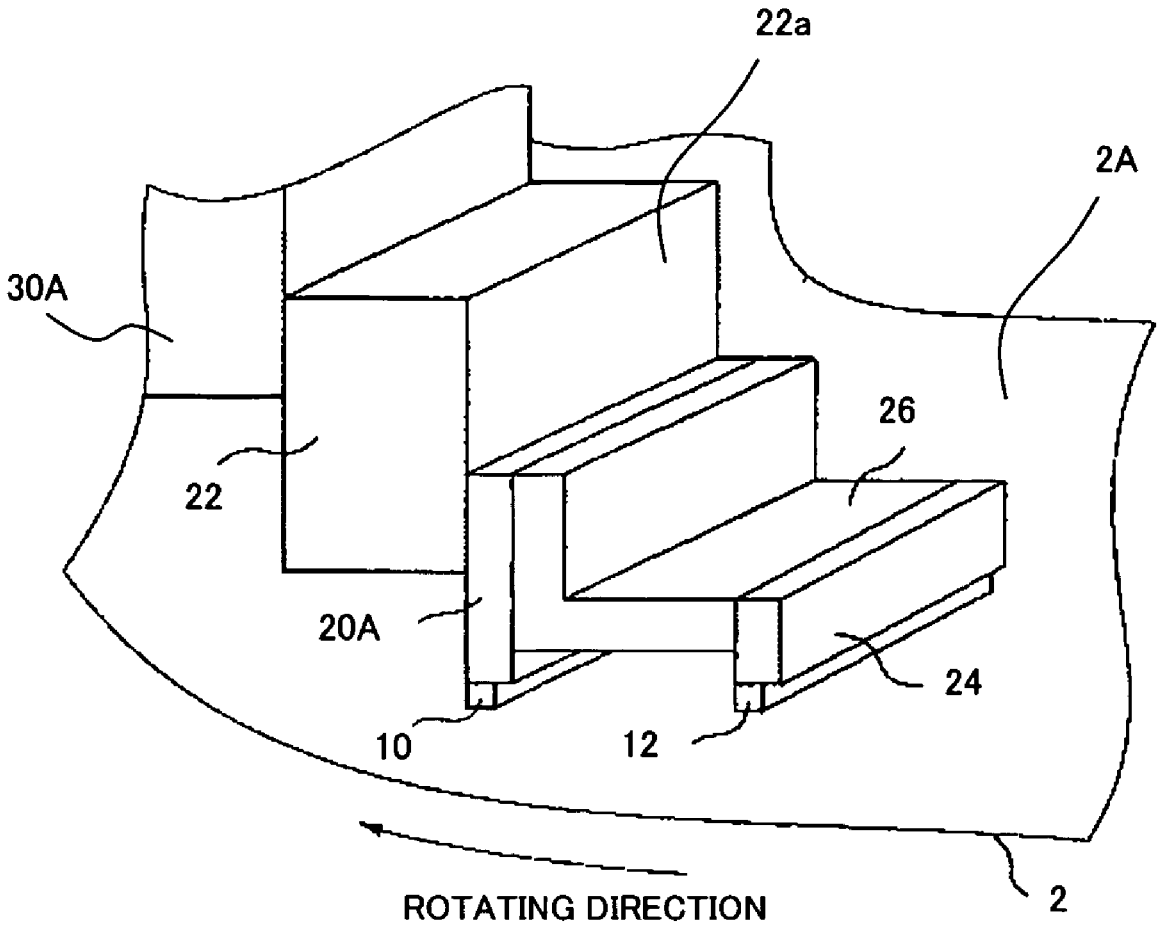
FIG. 11 is a partially enlarged section of principal part of another conventional lapping machine.
Figure 12:
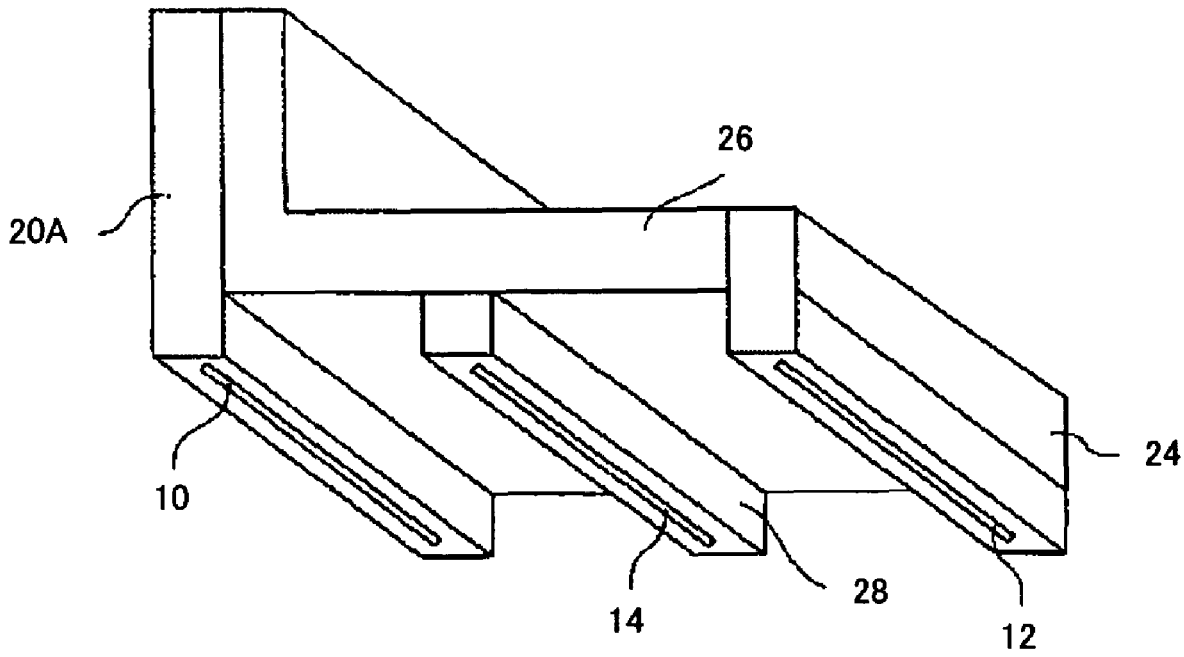
FIG. 12 is a partially enlarged section of principal part as a variation of a lapping machine shown in FIG. 11.

Referring now to FIG. 9, a description will be given of a method of attaching the transfer tool 110 to the machine head 130 of the lapping machine 100. Here, FIG. 9 is a flowchart for explaining the attachment method.

The head block 10 to which the detector is attached is adhered onto the bottom surface 111*a* of the transfer tool 110 (step 1002). In that case, the head block 10 is attached so that the condition shown in FIG. 8 is satisfied. Next, the dummy block 120 is adhered to the bottom surface 111*a* of the transfer tool 110 adjacent to the head block 10 so that the target planes 10*a* and 120*a* are coplanar parallel to the grinding plane 103 (step 1004). Prior to the step 1006, the number of dummy blocks 120 and a size of each dummy block 120 are determined.

Next, the printed board 150 is fixed onto the side surface 111*c* (step 1006). Next, the input terminals 152 of the printed board 150 and the output terminals 52 of the detectors are connected through the wires 159 (step 1008). Next, the transfer tool 110 is attached to the lapping machine body 130 so that the pressure mechanism 140 is adjacent to the side surface 111*b* and the dummy block 120 is arranged on the upstream side of grinding (step 1010). Next, the pin 156 on the probe card 158 is pressed against the output terminal 154 of the printed board 150 (step 1012).

After polishing, each head block 10 is cut into pieces of the magnetic head devices. The read head device of this embodiment is a TuMR device. However, the present invention does not limit a type of the read head device to the TuMR device, and may apply another MR head device, such as CPP-GMR, CIP-GMR, and AMR. The head device may be an MR inductive composite head that includes an MR head device and a write head device.

Figure 13:
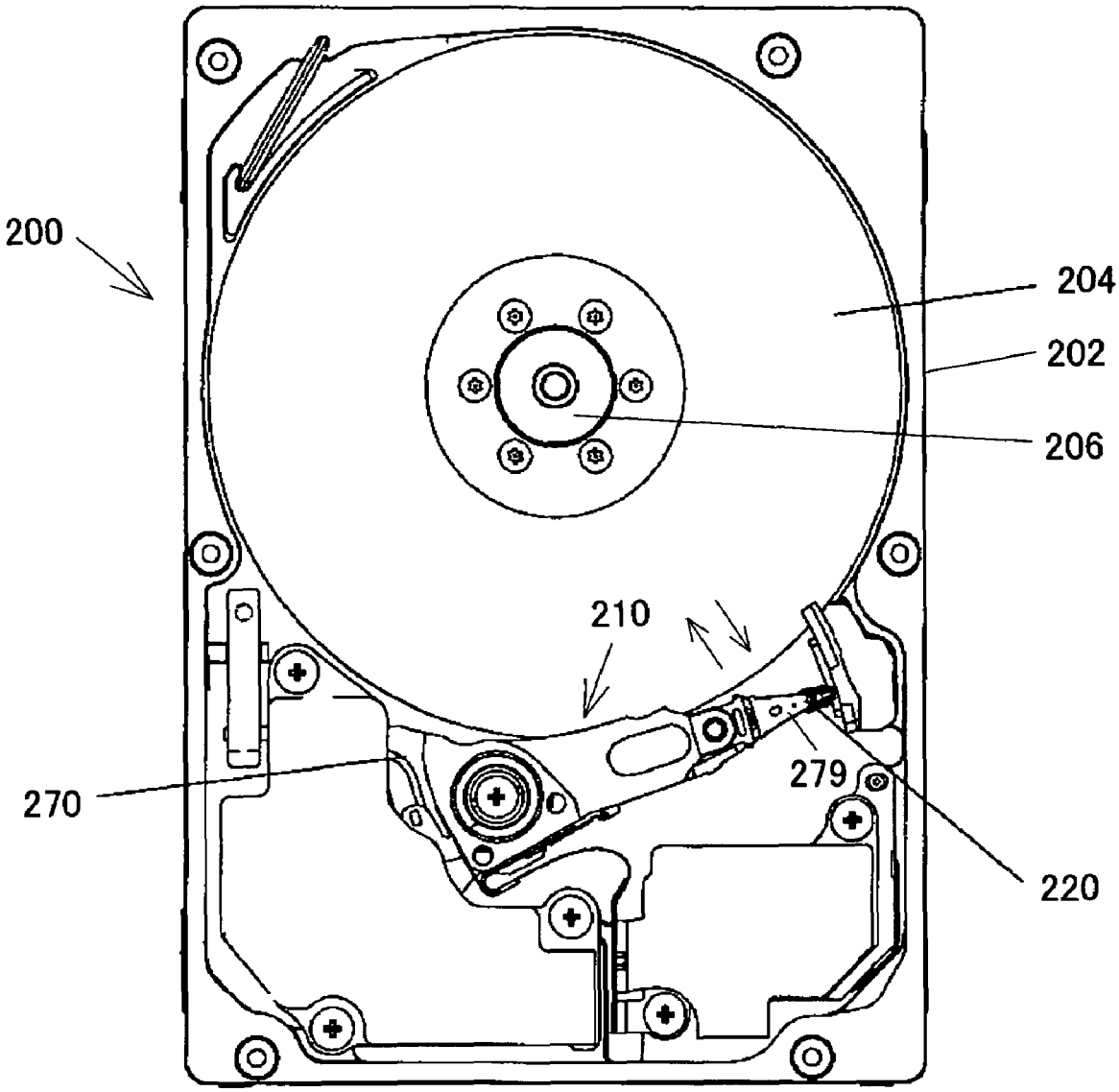
FIG. 13 is a plane view showing an internal structure of a hard disc drive ("HDD") according to one embodiment of the present invention.
Figure 14:
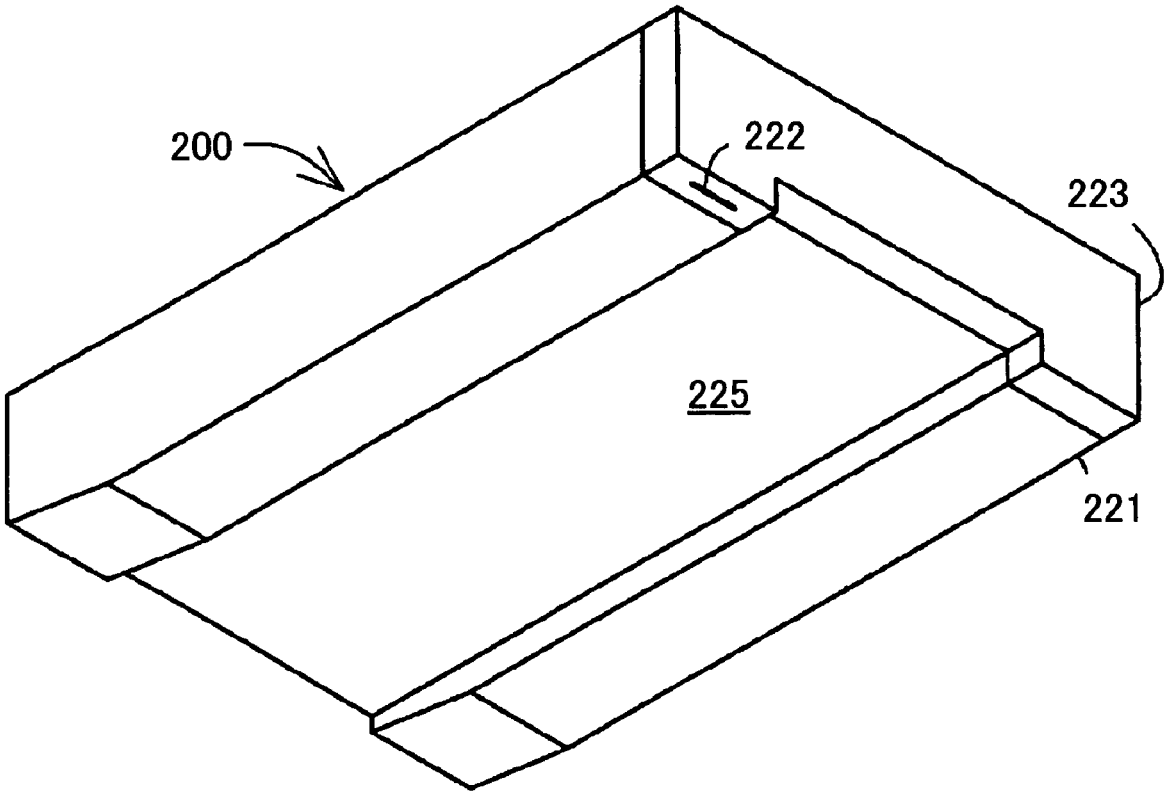
FIG. 14 is an enlarged plane view of a magnetic head part in the HDD shown in FIG. 13.
Figure 15:
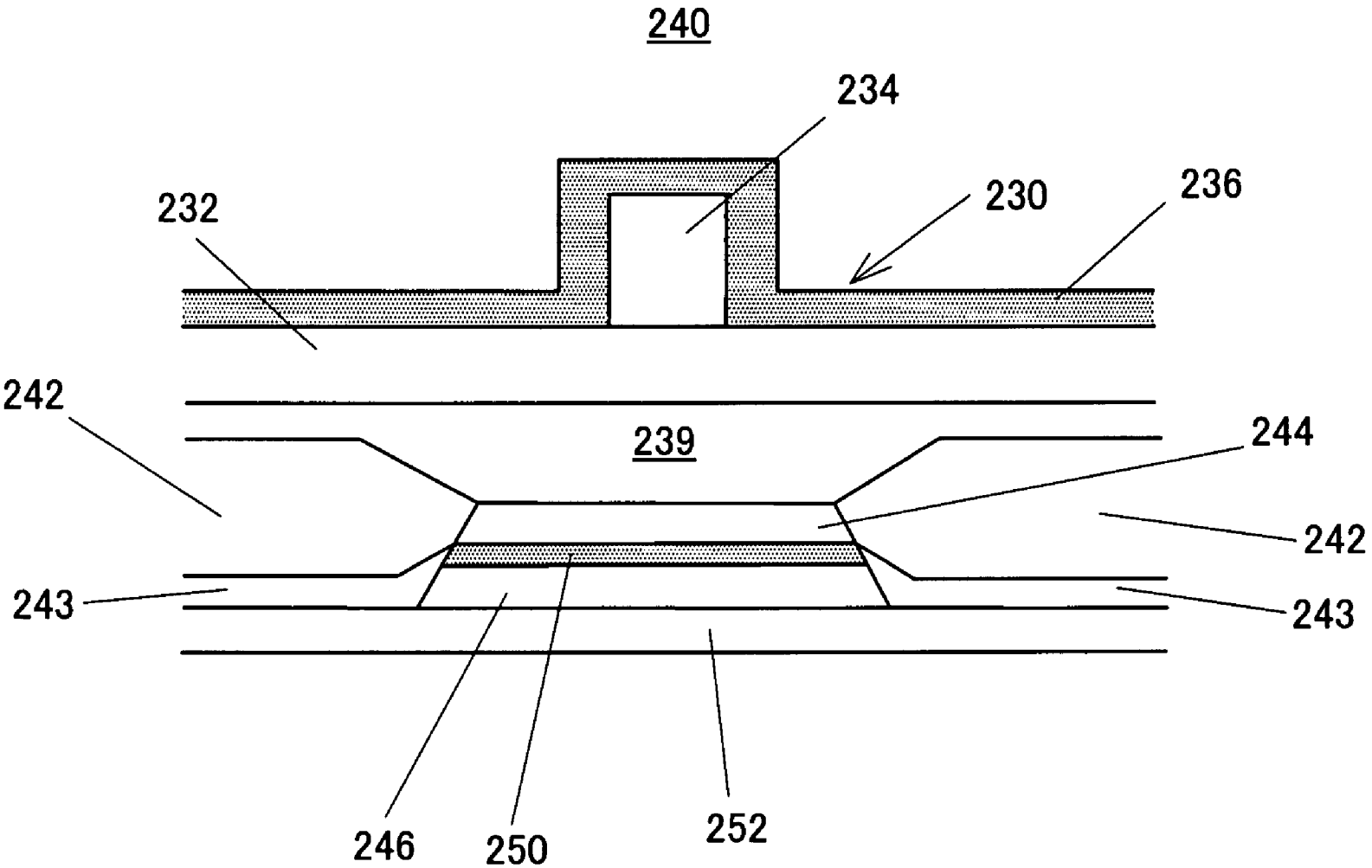
FIG. 15 is an enlarged sectional view of a layered structure of a head shown in FIG. 14.

Referring to FIGS. 13-15, a description will be given of an HDD 200 that includes an MR head device 240 of a current perpendicular to plane ("CPP")-TuMR structure manufactured by the inventive lapping machine. The HDD 200 includes, as shown in FIG. 13, one or plural magnetic discs 204 each serving as a recording medium, a spindle motor 206, and a head stack assembly ("HAS") 210 in an aluminum die cast housing 202. Here, FIG. 13 is a schematic plane view of the internal structure of the HDD 200.

The magnetic disc 204 of this embodiment has a high surface recording density, such as 100 Gb/in$^2$ or greater. The magnetic disc 204 is mounted on a spindle motor 206. The HSA 110 includes a magnetic head part 220, a carriage 270, and a suspension 279.

The magnetic head 220 includes a slider 221, and a head device built-in film 223 that is jointed with an air outflow end of the slider 221 and has a read/write head 222. The slider 221 has an approximately rectangular parallelepiped square made of $Al_2O_3$—TiC (altic), supports the head 222 and floats over the surface of the rotating disc 204. The head 222 records information into and reproduces the information from the disc 204. A surface of the slider 221 opposing to the magnetic disc 204 serves as a floating surface 225. Here, FIG. 14 is an enlarged view of the magnetic head part 220.

FIG. 15 is an enlarged view of the head 222. The head 222 is a MR inductive composite head that includes an inductive head device 230 that writes binary information in the magnetic disc 204 utilizing the magnetic field generated by a conductive coil pattern (not shown), and a magnetoresistive ("MR") head device 240 that reads the binary information based on the resistance that varies in accordance with the magnetic field applied by the magnetic disc 204.

The inductive head device 230 includes a non-magnetic gap layer 232, an upper magnetic pole layer 234, an insulating film 236, and an upper shield-upper electrode layer 239. As discussed later, the upper shield-upper electrode layer 239 forms part of the MR head device 240.

While FIGS. 7A to 7C show principal part, the MR head device 240 has a CPP structure that electrically connects a magnetoresistive device 250 to the upper shield-upper electrode layer 239 and lower shield-upper electrode 252, and applies the current perpendicular to the layered planes. Conductive gap layers 244 and 246 are provided on and under the magnetoresistive device 250, and an insulating layer 242 and a hard bias layers 243 are provided at both sides of the magnetoresistive device 250.

The carriage 270 serves to rotate the magnetic head part 220 in arrow directions shown in FIG. 13, and supports the suspension 279. The suspension 279 serves to support the magnetic head part 220 and to apply an elastic force to the magnetic head part 220 against the magnetic disc 204.

In operation of the HDD 200, the spindle motor 206 rotates the disc 204. The airflow associated with the rotation of the disc 204 generates a floating force that enables the slider 221 to float over the disc surface. The suspension 279 applies an elastic compression force to the slider 221 in a direction opposing to the floating force of the slider 221. This makes a balance between the floating force and the elastic force.

This balance spaces the magnetic head part 220 from the disc 204 by a constant distance. Next, the carriage 270 is rotated, and the head 122 is moved to a target track on the disc 204. In writing, data is received from the host (not shown) such as a PC through an interface, and modulated and supplied to the inductive head device 230. Thereby, the inductive head device 230 writes down the data onto the target track. In reading, the predetermined sense current is supplied to the MR head device 240, and the MR head device 240 reads desired information from the desired track on the disc 204. Since the MR head device 240 is made from the head block 10 that is polished at high precision by the lapping machine 100, and the MR head device 240 can read a signal magnetic field from the disc 204 highly sensitively.

Further, the present invention is not limited to these preferred embodiments, and various modifications and variations may be made without departing from the spirit and scope of the present invention.

The present invention can provide an easily manufactured lapping machine with an excellent yield, and a head device manufacturing method.

What is claimed is:

1. A lapping machine that polishes a head block in which plural head devices are connected in a row, said lapping machine comprising:

a jig that has a bottom surface that opposes to a grinding plane, and fixes the head block onto the bottom surface;

a pressure mechanism that applies a pressure to the head block against the grinding plane;

a detector that is connected to the head block and detects a grinding amount of the head block; and a dummy block fixed onto the bottom surface adjacent to the head block, wherein the head block has a layered structure including a first layer made of $Al_2O_3$—TiC and a second layer made of $Al_2O_3$, and the dummy block is made of $Al_2O_3$—TiC.

2. A grinding machine according to claim 1, wherein a surface of the head block on a side of the grinding plane and a surface of the dummy block on the side of the grinding plane are parallel to the grinding plane and coplanar.

3. A grinding machine according to claim 1, wherein the width of the dummy block is constant.

4. A lapping machine according to claim 1, wherein the jig has first and second side surfaces perpendicular to the bottom surface, and a perforation hole that perforates through the first and second side surfaces, and the pressure mechanism uses a linkage that partially protrudes in the perforation hole in the jig.

5. A lapping machine according to claim 1, further comprising a follow-up mechanism that makes the surface of the dummy block on the side of the grinding plane follow the grinding plane.

6. A lapping machine according to claim 1, wherein the dummy block is made of the same material as the hardest material in the head block.

* * * * *